United States Patent [19]

McBeth

[11] 4,067,536

[45] Jan. 10, 1978

[54] MOUNTING BRACKET FOR RECORD ALBUM COVERS

[76] Inventor: Charles R. McBeth, 200 Thompson, Richardson, Tex. 75080

[21] Appl. No.: 713,350

[22] Filed: Aug. 11, 1976

[51] Int. Cl.[2] ..... F16M 13/00

[52] U.S. Cl. ..... 248/475 R; 248/316 D

[58] Field of Search ..... 211/50; 248/316 D, 441 A, 248/441 B, 468, 475 R, 488, 490

[56] References Cited

U.S. PATENT DOCUMENTS

| | | | |
|---|---|---|---|
| 428,543 | 5/1890 | Yund | 248/302 X |
| 909,497 | 1/1909 | Williams | 211/50 |
| 993,404 | 5/1911 | Price | 248/300 |
| 1,015,213 | 1/1912 | Shands | 248/302 |
| 1,422,676 | 7/1922 | Czarnecki | 248/300 X |
| 2,564,517 | 8/1951 | Beals | 248/316 D |

*Primary Examiner*—William H. Schultz
*Attorney, Agent, or Firm*—Richards, Harris & Medlock

[57] ABSTRACT

A mounting bracket for record album covers and the like comprises a rear member adapted for engagement with a vertical surface. A lower portion of the rear member extends angularly outwardly, and a bottom member extends outwardly perpendicularly to the upper portion of the rear member. A front member extends angularly upwardly and inwardly to an upper end normally positioned with the clearance between the vertical projections of the rearward extremity of the front member upper end and the forward extremity of the rear member lower end less than, but with the clearance between the rearward extremity of the front member upper end and the upper front surface of the rear member greater than the thickness of the record album cover to be supported. The front member therefore applies a moment to a record album cover supported on the bottom member tending to pivot the upper end of the record album cover toward the supporting wall. In one embodiment the mounting bracket comprises a plastic extrusion. In another embodiment the mounting bracket is formed from wire.

7 Claims, 4 Drawing Figures

MOUNTING BRACKET FOR RECORD ALBUM COVERS

BACKGROUND AND SUMMARY OF THE INVENTION

This invention relates in general to a mounting bracket, and in particular, to a means of holding an object on a wall without requiring a frame or attachment, particularly facilitating ease of repeated removal and remounting of the object.

Much of the best pictoral art produced over the past twenty years appears on long-playing phonograph record album covers, but there has been no convenient, inexpensive, non-detracting means of displaying such album covers for viewing. In addition, conventional means of hanging or mounting pictures, if adapted to the wall mounting of record album covers, generally would prohibit keeping a record in the cover in such a way as to conveniently remove the record for use or insert it for storage. Consequently, this great quantity of art has little utility beyond initially attracting the eye of a potential purchaser of a phonograph record.

It is, therefore, a principle object of this invention to provide a convenient mounting device for holding a phonograph record album cover on a wall for visual display without interfering with the record protecting utility thereof.

Another object of this invention is to provide non-detracting means of visually displaying art work.

An additional object of this invention is to provide means for mounting art work without a frame or attachment.

A further object of this invention is to provide means for mounting art work while allowing easy and repeated removal and remounting of the art work.

A still further object of this invention is to facilitate ease of aligning a plurality of art works in desired horizontal and vertical patterns.

Another object of this invention is to provide a mounting bracket in which an art work can be repositioned horizontally without affecting its vertical position or its angularity, after first affixing the bracket to a wall.

Features of this invention useful in accomplishing the above objects include, in a mounting bracket, a rear member which can be attached to a wall or other generally vertical surface, having a forward extremity lower than the rearward extremity of a front member joined to the rear member by a bottom member below these extremities, and having a horizontal displacement, between these extremities, less than the thickness of the phonograph record album cover or other mounted item, singularly or with shims, and having flexible members joining these extremities, having the clearance between the rearward extremity of the front member and the front surface of the rear member greater than the thickness of the mounted item, with the front surface of the rear member connected to its forward extremity with a forwardly inclined surface, thereby facilitating easy insertion of the mounted item down and into the bracket by sliding down the inclined surface which acts as a wedge causing the mounted item to displace, forward, the front member. The bottom edge of the mounted item will rest on the bottom member of the bracket with the lower forward extremity of the rear member pushing on the lower rear of the mounted item while the upper rearward extremity of the front member pushes on a higher area of the front of the mounted item with a force dependent upon the flexure of the members joining these displaced extremities, thereby creating a force couple holding the top back surface of the mounted item against the wall to which the bracket is attached, thus allowing repeated removal and remounting of the mounted item without altering its appearance or utility. Used singularly to mount an art work, the width of the bracket would be not less than 5% of the width of the art work and would be attached to a wall with not less than two fasteners, thereby allowing the art work to be repositioned over the width of the bracket, as long as the art work's center of gravity is within the bracket width, and the bracket will be prevented from rotating by the multiple fasteners. The same effect will result by using a plurality of brackets, which may be narrower and attached to the wall with as few as one fastener each, as long as the art work's center of gravity is between the outside bracket's fasteners, or between the outside bracket's extreme edges if two or more fasteners are used in the outside brackets.

DESCRIPTION OF THE DRAWINGS

Specific embodiments respecting what are presently regarded as the best modes of carrying out the invention are illustrated in the accompanying Drawings, wherein.

DETAILED DESCRIPTION

Figure 1:
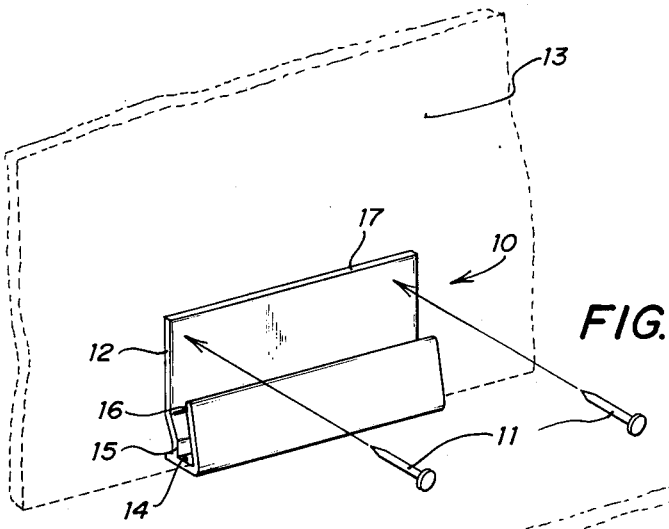
FIG. 1 represents a perspective view of a mounting bracket, capable of being fabricated by the extrusion process, showing nails for fastening to a wall, and indicating with phantom lines an item mounted in the bracket.

Referring to the Drawings, FIG. 1 shows a mounting bracket 10 comprising a first embodiment of the invention. Two nails 11 may be driven through the rear member 12 of the bracket 10 to attach it to a wall, with the mounted item 13 setting on the bottom member 14 of the bracket between the lower forward extremity 15 of the rear member 12 and the upper rearward extremity 16 of the front member 19 of the bracket. The top edge 17 is parallel to the bottom member 14 of the bracket.

Figure 3:
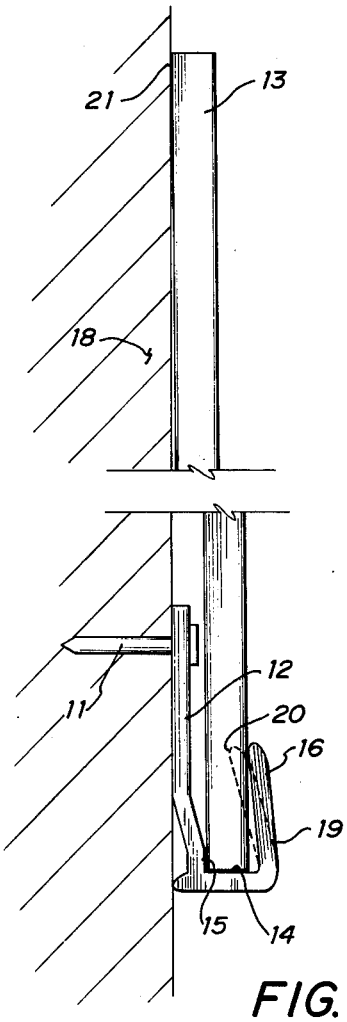
FIG. 3 is an end view of an item mounted in the bracket of FIG. 1, showing a cross section of the wall with the bracket nailed to the wall, and indicating with the phantom lines the displacement of the bracket.

In FIG. 3 a nail 11 is shown driven through the rear member 12 of the bracket 10 fastening it to the wall 18. The mounted item 13 is resting on the bottom member 14 of the bracket with its lower rear surface pressed against the lower forward extremity 15 of the bracket and a higher front surface of the mounted item 13 pressed against the upper rearward extremity 16 of the bracket having displaced the front member 19 of the bracket to the flexed position from its normal relaxed position 20 assumed with the mounted item 13 removed. The flexure in the front member 19 and the bottom member 14 of the bracket 10 results in the upper rearward extremities 16 pushing the mounted item 13 with a torque force around the lower forward extremity 15 until the top rear surface 21 of the mounted item 13 rests against the wall 18, holding the mounted item 13 in the bracket and against the wall 18.

Figure 2:
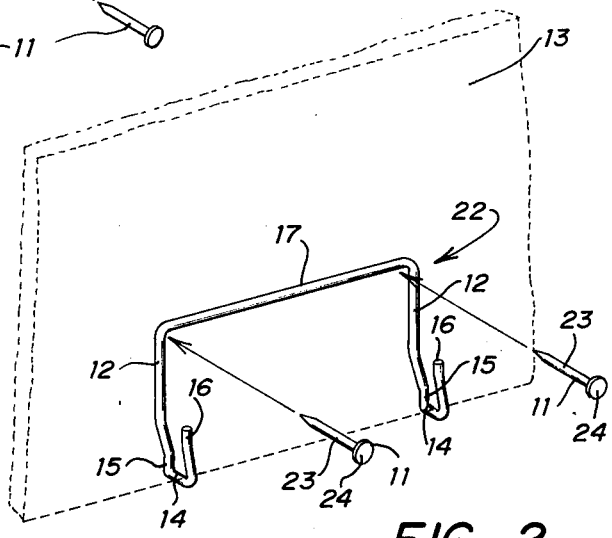
FIG. 2 is a perspective view of a mounting bracket, capable of being fabricated of wire, showing nails for fastening to a wall, and indicating with phantom lines an item mounted in the bracket.

Referring to FIG. 2 there is shown a mounting bracket 22 comprising a second embodiment of the invention. Two nails 11' may be driven into the wall with the spike 23 portion of each nail just below the top edge 17' of the bracket and just inside each rear leg member 12' of the bracket allowing the head 24 of each nail to hold the bracket to the wall by its top member 17' and both leg members 12', with the mounted item 13' setting on the bottom leg members 14' of the bracket between the lower forward extremity 15' of each rear leg member 12' and the upper rearward extremity 16' of each front leg member 19' of the bracket. The top edge 17' is parallel to the plane of the bottom leg members 14' of the bracket.

Figure 4:
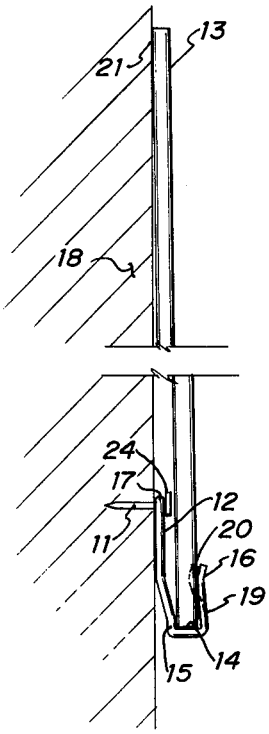
FIG. 4 is an end view of a item mounted in the bracket of FIG. 2, showing a cross section of the wall with the bracket nailed to the wall, and indicating with the phantom lines the displacement of the bracket.

In FIG. 4 a nail 11' is shown driven into the wall 18' fastening the bracket to the wall by holding the top member 17' of the bracket and the rear leg member of the bracket against the wall with the head 24 portion of the nail. The mounted item 13' is resting on the bottom leg members 14' of the bracket with its lower rear surface pressed against the lower forward extremity 15' of the bracket and a higher front surface of the mounted item 13' pressed against the upper rearward extremity 16' of the bracket having displaced the front member 19' of the bracket to the flexed position from the normal relaxed position 20' assumed with the mounted item 13' removed. The flexure in the front member 19' and the bottom member 14' of the bracket results in the upper rearward extremity 16' pushing the mounted item 13' with a torque force around the lower forward extremity 15' until the top rear surface 21' of the mounted item 13' rests against the wall 18' holding the mounted item 13' in the bracket 10' against the wall 18'.

As shown in FIGS. 3 and 4 the mounted item 13 or 13' hides the rear portion of the bracket and the mounting nails and any shim which might be placed between the bracket's lower forward extremity 15 or 15' and the lower rear portion of the mounted item 13 or 13', with the lower portion of the bracket 14 or 14' below the mounted item 13 or 13', leaving only the front member 19 or 19' of the bracket to intefere with the vision of the mounted item 13 or 13'. However, the bracket shown in FIGS. 1 and 3 is made of a transparent material and the bracket shown in FIGS. 2 and 4 is made of a relatively thin wire thereby leaving the view of the mounted item 13 or 13' unobscured.

The mounting bracket 10 shown in FIGS. 1 and 3 may be formed from various plastic materials, preferably plastic materials having good toughness, high elasticity, and high transparity. Although various manufacturing techniques may be utilized in the fabrication of the mounting bracket 10, the use of the extrusion process in the fabrication of the mounting bracket 10 is preferred. By means of the extrusion process, the mounting bracket 10 may be fabricated inexpensively while maintaining a high degree of accuracy.

The mounting bracket 22 shown in FIGS. 2 and 4 is preferably formed from one of the various commercially available types of wire having good toughness and high elasticity. For example, stainless steel wire may be utilized in the fabrication of the mounting bracket 22. Conventional wire bending techniques are preferably employed to fabricate the mounting bracket 22 from standard wire stock.

From the foregoing it will be understood that the present invention incorporates numerous advantages over the prior art. Thus, by means of the invention objects such as phonograph record album covers are conveniently displayed without detracting therefrom. Another advantage deriving from the use of the invention involves the fact that by means thereof an art work may be displayed without a frame or attachment. Still another advantage deriving from the use of the invention involves the fact that by means thereof an art work or similar object may be easily and repeatedly removed and remounted. Still another advantage deriving from the use of the invention involves the fact that by means thereof the accurate alignment of art works in desired horizontal and vertical patterns may be readily effected. Other advantages will readily suggest themselves to those skilled in the art.

Although preferred embodiments of the invention have been illustrated in the accompanying Drawings and described in the foregoing Detailed Description, it will be understood that the invention is not limited to the embodiments shown and described, and that various modifications, substitutions, and rearrangements thereof may be made without departing from the spirit of the invention.

What is claimed is:

1. A mounting bracket for displaying objects having a predetermined thickness on vertical surfaces comprising:

a rear member having a substantially planar upper portion adapted for engagement with the vertical surface;

the rear member having a lower portion extending angularly downwardly and outwardly to a lower end positioned substantially outwardly from the upper portion of the rear member;

a bottom member extending from the lower end of the rear member substantially perpendicularly to the upper portion of the rear member;

said bottom member having an inner end coincident with the lower end of the rear member and a substantially outwardly displaced outer end;

a front member extending angularly upwardly and inwardly from the outer end of the bottom member to an upper end normally positioned with the clearance between the vertical projections of the rearward extremity of the front member upper end and the forward extremity of the rear member lower end less than the predetermined thickness of the object and with the clearance between the rearward extremity of the front member upper end and the upper front surface of the rear member being greater than the thickness of the object; and said bottom member for supporting an object between the rear member and the front member so that the flexure of the front member applies a moment to the object tending to pivot the upper end of the object toward the supporting wall.

2. The mounting bracket according to claim 1 wherein the rear member, the bottom member and the front member comprise an integral structure.

3. The mounting bracket according to claim 2 wherein the mounting bracket is formed from plastic.

4. The mounting bracket according to claim 2 wherein the mounting bracket is formed from wire.

5. The mounting bracket according to claim 3 wherein the plastic has a high degree of transparency.

6. The mounting bracket according to claim 3 used in combination with two or more fasteners for securing the bracket to the vertical surface.

7. The mounting bracket according to claim 4 used in combination with two or more fasteners for securing the bracket to the vertical surface.

* * * * *